United States Patent [19]

Nonaka

[11] Patent Number: 4,689,966

[45] Date of Patent: Sep. 1, 1987

[54] REFRIGERATION HAVING MODE-CHANGE CHAMBER CAPABLE OF OPERATION WITHIN FREEZING, CHILL AND REFRIGERATION TEMPERATURE RANGES

[75] Inventor: Hikaru Nonaka, Osaka, Japan

[73] Assignee: Kabushiki Kaisha Toshiba, Kawasaki, Japan

[21] Appl. No.: 792,585

[22] Filed: Oct. 29, 1985

[30] Foreign Application Priority Data

Nov. 15, 1984 [JP] Japan ..... 59-241232

[51] Int. Cl.[4] ..... F25D 17/04

[52] U.S. Cl. ..... 62/187; 62/163; 62/202; 62/326

[58] Field of Search ..... 62/202, 187, 326, 163, 62/161, 162, 164, 441, 126, 125; 236/68 R, 68 B

[56] References Cited

U.S. PATENT DOCUMENTS 2,322,714 6/1943 Kalischer ..... 62/163

FOREIGN PATENT DOCUMENTS 104069 8/1979 Japan ..... 62/187
39261 9/1980 Japan .
161480 8/1984 Japan .

*Primary Examiner*—Harry Tanner
*Attorney, Agent, or Firm*—Cushman, Darby & Cushman

[57] ABSTRACT

A refrigerator includes a mode-change chamber, having first and second dampers which may be selectively used as a freezer compartment, refrigeration compartment or chill compartment. When the freezer compartment mode is selected, the first damper permits the flow of cold air into the mode-change chamber to maintain the temperature in the mode-change chamber at a freezing temperature. When the refrigerating compartment mode is selected, the second damper permits the flow of cold air into the mode-change chamber to maintain the temperature in the mode-change chamber at the selected refrigeration temperature. When the chill compartment mode is selected, the control temperature of the second damper is forcibly expanded by a heater to maintain the temperature in the mode-change chamber at a chill temperature between the freezing and refrigeration temperatures.

3 Claims, 10 Drawing Figures

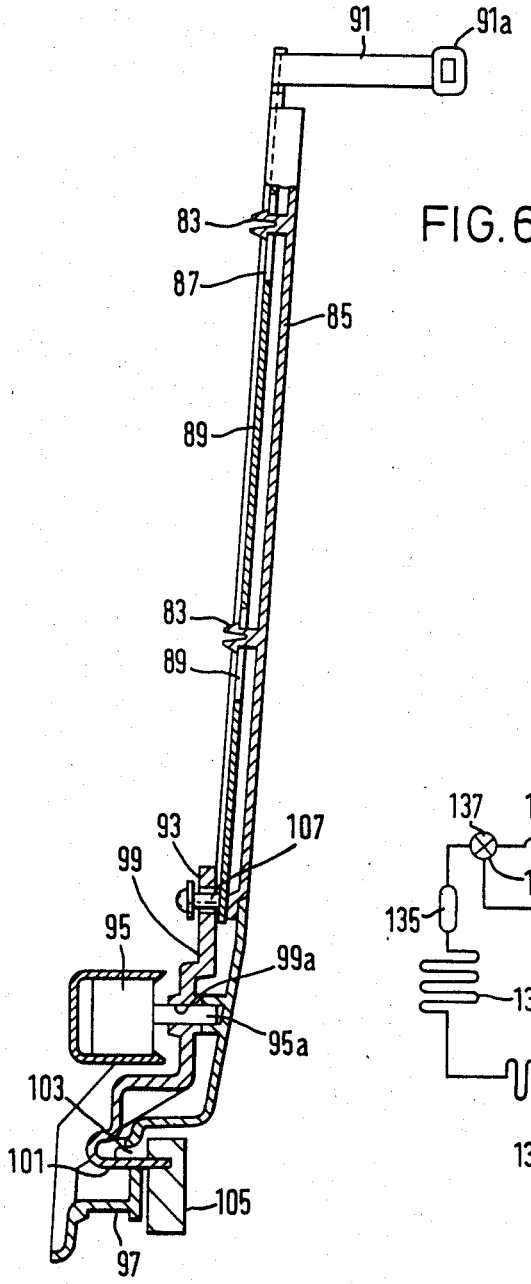
FIG. 6
FIG. 9
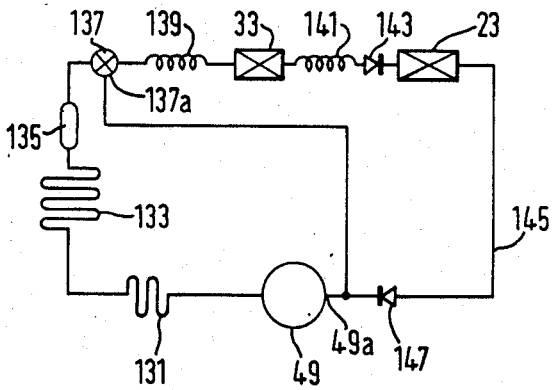

REFRIGERATION HAVING MODE-CHANGE CHAMBER CAPABLE OF OPERATION WITHIN FREEZING, CHILL AND REFRIGERATION TEMPERATURE RANGES

BACKGROUND OF THE INVENTION

1. Field of the Invention

The present invention relates to a refrigerator including a freezing chamber, refrigerating chamber and mode-change chamber.

2. Description of the Prior Art

Refrigerators having a mode-change chamber independently of a freezing chamber and refrigerating chamber are in and of themselves known. The conventional mode-change chamber is capable of operating as a refrigeration compartment mode or being selectively changed between a chill compartment mode in which it is maintained at a temperature, e.g. of about 0° C., which is lower than the temperature in the refrigeration compartment mode.

Conventional mode-change chambers utilize a cold air intake port formed in a side wall of the mode-change chamber and which communicates with the cold air passage of a refrigerating main body. A damper device is mounted therein, thereby changing the mode-change chamber to the refrigerating compartment mode or chill compartment mode in response to manual adjustment of the temperature controlling knob of the damper device to optimum temperatures of each mode.

The above-described conventional refrigerator allows the mode-change chamber to be used in only two ways—that is, as a refrigeration compartment or a chill compartment—which is unsatisfactory in terms of convenience of use. If, for example, a user desires to store a large amount of frozen foods in the freezer compartment temporarily, there is a problem that the freezer compartment will not have sufficient capacity. To solve this problem the mode-change chamber could be changed to a freezing compartment mode, but it is not possible to adjust its operating temperature the same as that of the freezer compartment even if the user tries to do so by actuating the temperature controlling knob, since the range of the damper device's operating temperature cannot be set to a range as broad as the temperature difference between the freezing chamber and refrigerating chamber.

SUMMARY OF THE INVENTION

It is therefore an object of the present invention to provide an improved damper mechanism wherein the mode-change chamber can be used in three ways—that is, as a refrigeration compartment, chill compartment or freezer compartment, thus enhancing the convenience of its use.

In accordance with an aspect of the present invention, such functions are achieved by providing the means for expanding (i.e. raising) the temperature of the mode-change chamber so that it exhibits a "chill temperature" between the freezing temperature of the freezer compartment and the refrigerating temperature of the refrigeration compartment. Thus, upon deactivation of the temperature expanding means and selective operation of first or second dampers associated with air intake ports in communication with the mode-change chamber, the mode-change chamber can be selected to function as an auxiliary freezer compartment or an auxiliary refrigerator compartment, respectively.

BRIEF DESCRIPTION OF THE ACCOMPANYING DRAWINGS

The present invention will be better understood by reference to the accompanying drawings, wherein like reference numerals throughout the various Figures denote like structural elements, and wherein:

FIG. 6 is a cross-sectional view thereof taken substantially along the line VI—VI of FIG. 5;

FIG. 9 is a diagram of a refrigeration circuit; and

DETAILED DESCRIPTION OF THE PREFERRED EXEMPLARY EMBODIMENT

A particularly preferred embodiment of the present invention will now be described in more detail with reference to the accompanying drawings.

Figure 1:
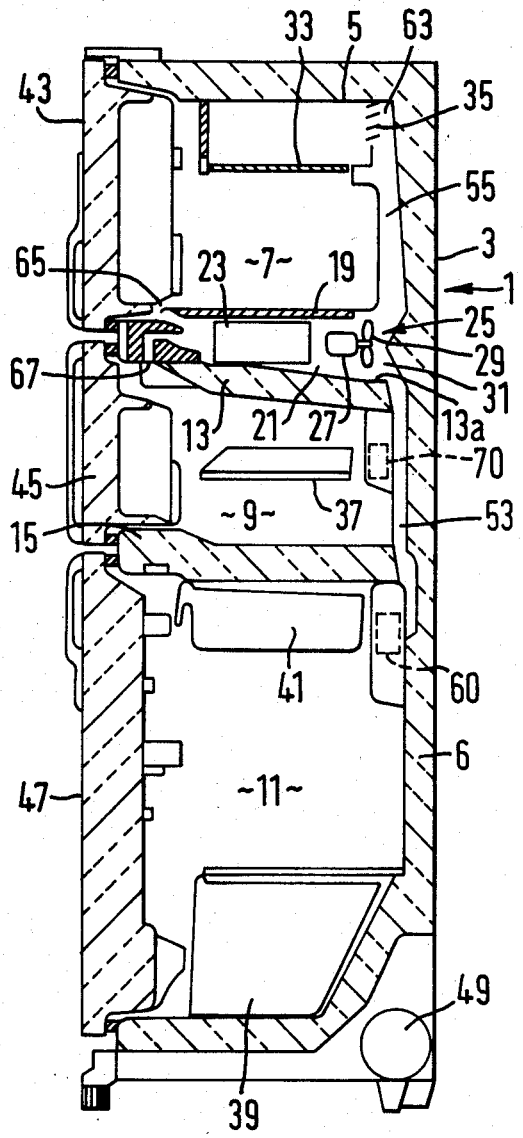
FIG. 1 is a vertical sectional view of a refrigerator in accordance with a preferred embodiment of the present invention.

An overall assembly of a refrigerator of the present invention is shown in accompanying FIG. 1. A refrigerator main body 1 is formed with an outer wall 3 and inner wall 5, which together establish a heat insulation space filled with heat insulation material 6 to inhibit heat from being transmitted from inner wall 5 to outer wall 3. The interior of main body 1 is partitioned into three chambers (i.e. a freezing chamber 7, a mode-change chamber 9 and a refrigerating chamber 11 serially from top to bottom) by a pair of heat insulation partition walls 13 and 15 provided therein. The interior of heat insulation partition wall 13 which separates freezing chamber 7 and mode-change chamber 9 is hollow and thus defines an open upper surface 13*a* which is covered by panel 19 so as to form a cooling chamber 21 inside insulation partition wall 13. A main evaporator 23 and, to the rear thereof, a fan device 25 are provided in cooling chamber 21. Fan device 25 is equipped with a fan motor 27 and a fan 29 to force cold air produced by main evaporator 23 into a cold air passage 31 at the rear of cooling chamber 21.

A flat plate-shaped cooler 33 for direct cooling, is provided in the form of a shelf, and is positioned below a grille 35 (described in greater detail below) at the top of the interior of freezing chamber 7. A food tray 37 is preferably arranged in the middle of mode-change chamber 9 while a crisper 39 (e.g. vegetable container) is disposed in the bottom of refrigerating chamber 11 so as to be slideably movable to permit greater access thereto by the user. A fresh-tray 41 is also preferably provided in the upper part of refrigerating chamber 11. A freezer-door 43, a mode-change-door 45 and a refrigerator-door 47 are pivotally movably mounted to main body 1, so as to respectively close freezing chamber 7, mode-change chamber 9 and refrigerating chamber 11. A compressor 49 is also provided below refrigerating chamber 11.

Figure 2:
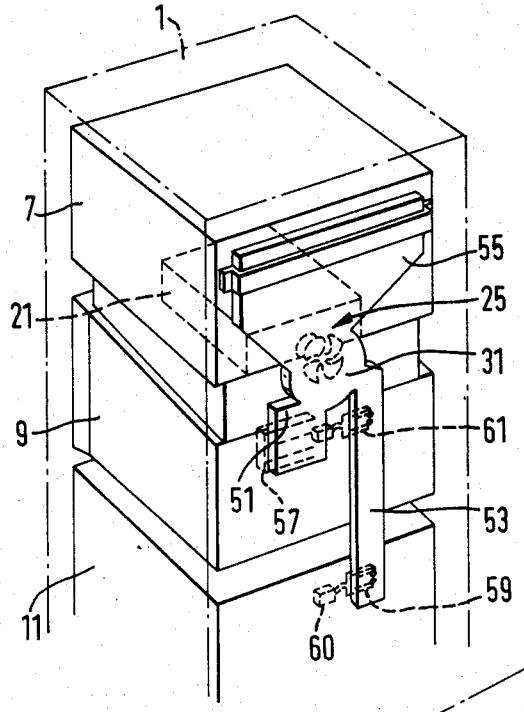
FIG. 2 is a perspective view from the rear of the refrigerator showing the cold air passages.

As shown in FIG. 2, cold air passage 31 includes a first duct 51, second duct 53 and third duct 55 all formed at the rear of refrigerator main body 1. One end of first duct 51 opens into cooling chamber 21, while the other end opens into mode-change chamber 9 through a first air intake port 57 formed at the rear wall of mode-change chamber 9. One end of second duct 53 opens into cooling chamber 21, and another end thereof opens into refrigerating chamber 11 through a second air intake port 59 formed at the rear wall of refrigerating chamber 11.

A refrigerating damper device 60 is operatively mounted on second air intake port 59 to control the flow rate of cold air flowing into refrigerating chamber 11 through second air intake port 69 so as to maintain the refrigerating chamber 11 at a preselected temperature. Second duct 53 further communicates with mode-change chamber 9 through a third air intake port 61 formed at the rear wall of mode-change chamber 9. One end of third duct 55 also opens into cooling chamber 21, and another end thereof communicates with freezing chamber 7 through a fourth air intake port 63 (shown in FIG. 1) which is formed in the rear wall of freezing chamber 7 over the entire transverse width thereof. Third duct 55 preferably has the largest cross-sectional dimension while second duct 53 has the smallest cross-sectional dimension, the cross-sectional dimension of first duct 51 thereby being intermediate the two.

A first air discharge port 65 is formed at the front upper portion of cooling chamber 21, so that cooling chamber 21 communicates with freezing chamber 7 therethrough (as shown in FIG. 1). A second air discharge port 67 is formed at the front bottom portion of cooling chamber 21, so that cooling chamber communicates with mode-change chamber 9 therethrough (as is also shown in FIG. 1.

Figure 3:
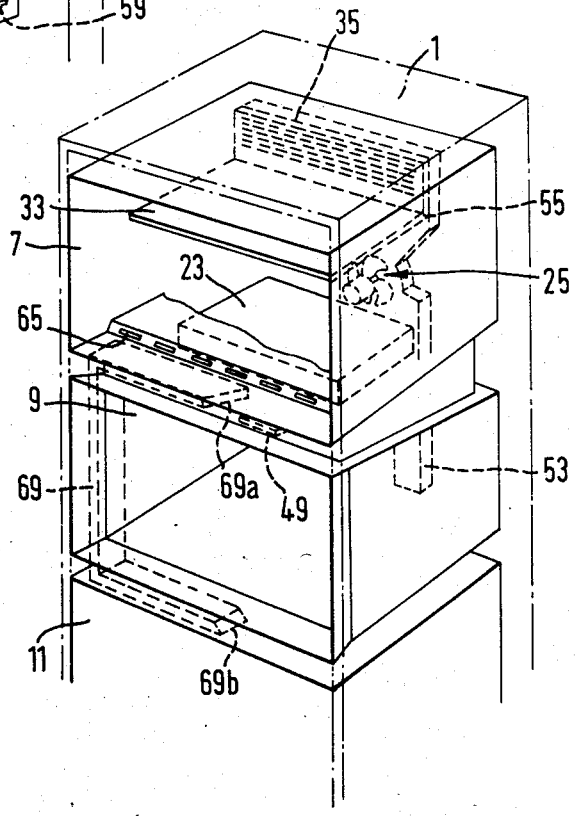
FIG. 3 is a perspective view from the front of the refrigerator shown in FIG. 2.

Referring to FIG. 3, grille 35 is attached to the entire portion of fourth air intake port 63, and an air discharge path 69 is formed along a side wall of mode-change chamber 9. One end 69*a* of air discharge path 69 opens into cooling chamber 21 while the other end 69*b* opens into refrigerating chamber 11, so that cooling chamber 21 communicates with refrigerating chamber 11 through air discharge path 69.

Figure 4:
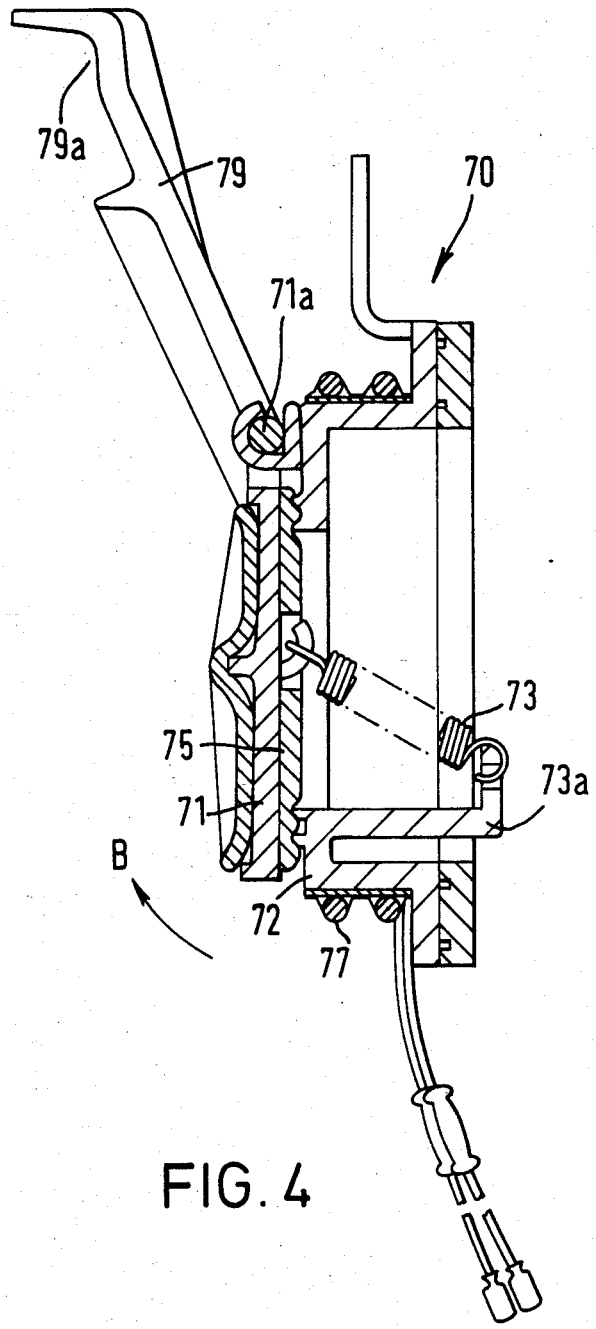
FIG. 4 is a vertical sectional view of a first damper device used in one embodiment of the present invention.

As shown in FIG. 4, a first damper 70, which is provided in first air intake port 57 positioned in the back wall of mode-change chamber 9, includes a damper plate 71 pivotally connected by means of hinge 71*a* to an angle tube 72. A tension spring 73, which normally biases damper plate 71 into a closed position, is provided between damper plate 71 and an engagement portion 73*a* inwardly projecting from angle tube 72. In order to enhance the sealing characteristics upon closure of damper plate 71, an elastomeric sealing member 75 is bonded to the outside surface of damper plate 71. A damper heater 77 is wound around the periphery of angle tube 72 so as to prevent it from freezing. Operating lever 79 is integrally formed with damper plate 71 and upwardly projects therefrom, so that damper plate 71 can be manually pivoted when the top of operating lever 79 is pressed in a direction against the biasing force of tension spring 73 (i.e. in the direction of arrow B).

Figure 5:
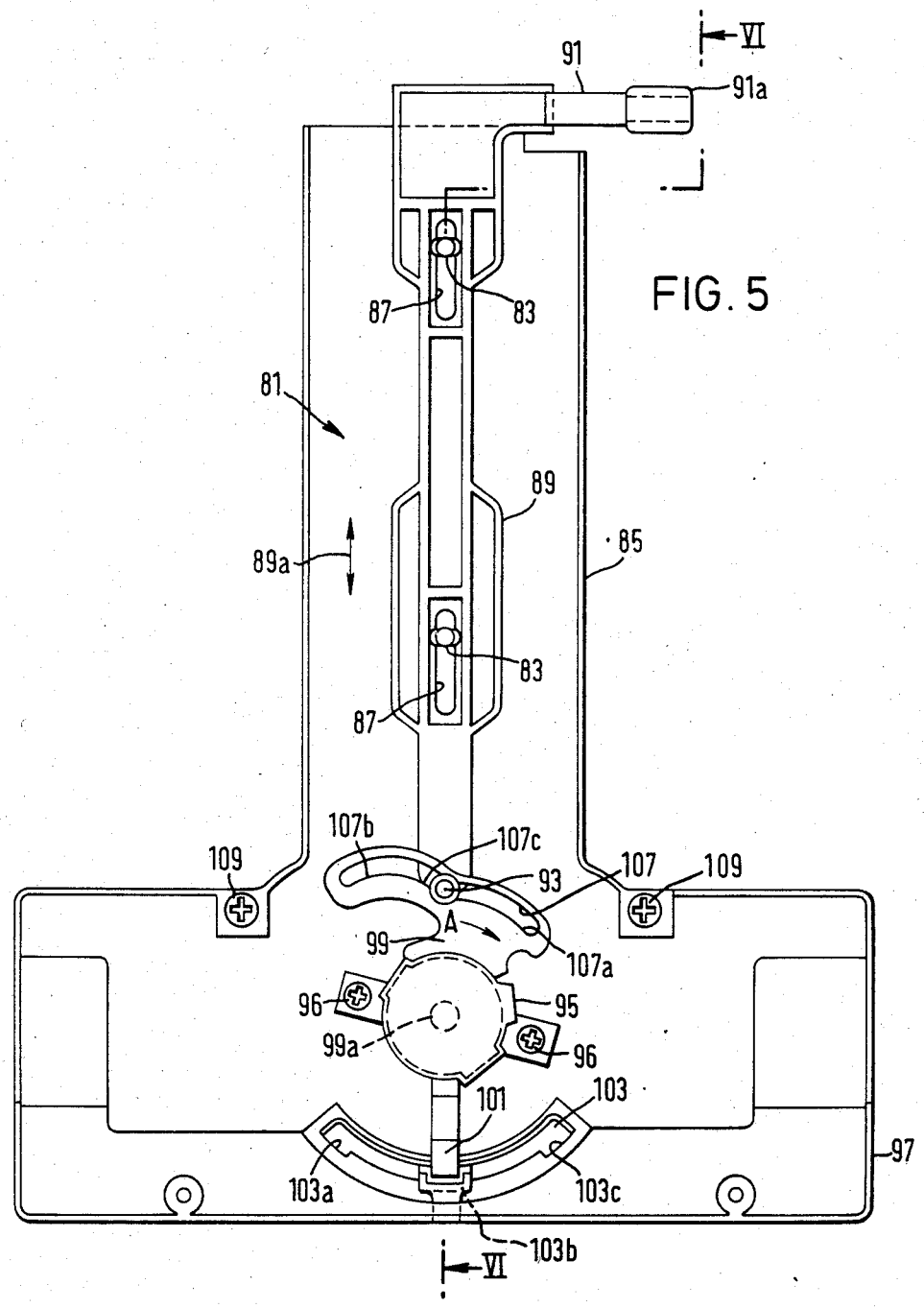
FIG. 5 is a plan view of the controlling mechanism of the first damper device shown in FIG. 4.

An operating mechanism 81 for enabling the first damper 67 to be opened is shown in FIGS. 5 and 6. A pair of guide projections 83, projecting from the surface of a support plate 85, are provided separately in the elongated direction of support plate 85. A pair of slots 87 are provided on the surface of operating rod 89 and are separated in the elongated direction of rod 89 so as to be in registry with the pair projections 83. Thus, operating rod 89 is supported on the surface of support plate 85 by guide projections 83 slidably received in slots 87 so that rod 89 is movable forward and backward along the elongated direction of support plate 85 (i.e. as shown by arrow 89*a* in FIG. 5).

An L-shaped pressing portion 91 is fixed to the one end of operating rod 89, and a pressing element 91*a* is removably mounted at the top thereof. An upwardly projecting engagement projection 93 is formed at the forward end of operating rod 89. A rotary switch 95 whose rotary shaft 95*a* projects downwardly therefrom is rotatably mounted at the forward portion of supporting plate 85 and is retained in its position by means of cover unit 97 fixed to supporting plate 85 by screws 96. A shaft hole 99*a*, formed in the middle of a cam plate 99, is engaged with rotary shaft 95*a*, so that cam plate 99 and rotary shaft 95*a* rotate together as a unit as shown in FIG. 6.

An operating element 101, integral with cam plate 99, projects downwardly through a slit 103 formed in operating unit cover 97. Slit 103 is shaped in an arc of a circle whose center coincides with the center of cam plate 99. A knob 105 is fixed to the projecting end of operating element 101. Operating element 101 of cam plate 99 is integrally resiliently biased in a forwardly direction so that it is normally in resilient contact with the front peripheral wall of slit 103.

Engagement recesses 103*a*, 103*b* and 103*c* are formed at respective locations along the arc of the front peripheral wall of slit 103 in order to maintain operating element 101, and thus cam plate 99, in a rotary position corresponding to a respective recess 103*a*, 103*b* and 103*c*. An arc-shaped cam groove 107 which is engaged with projection 93 of operating rod 89 is formed in the portion of cam plate 99 being opposite to operating element 101. Cam groove 107 includes a first cam face 107*a* formed along an arc of prescribed radius whose center is shaft hole 99*a* of cam plate 99, a second cam face 107*b* formed along an arc of larger radius (relative to first cam face 107*a*) also with its curvature center at shaft hole 99*a*, cam face 107*c* of increasing radius which serves to provide a continuous cam track between cam faces 107*a* and 107*b*. Supporting plate 85 (on which is mounted operating rod 89) and operating unit cover 97 (on which are mounted rotary switch 95 and cam plate 99) are fixed to one another as a unit by means of screws 109.

Figure 7:
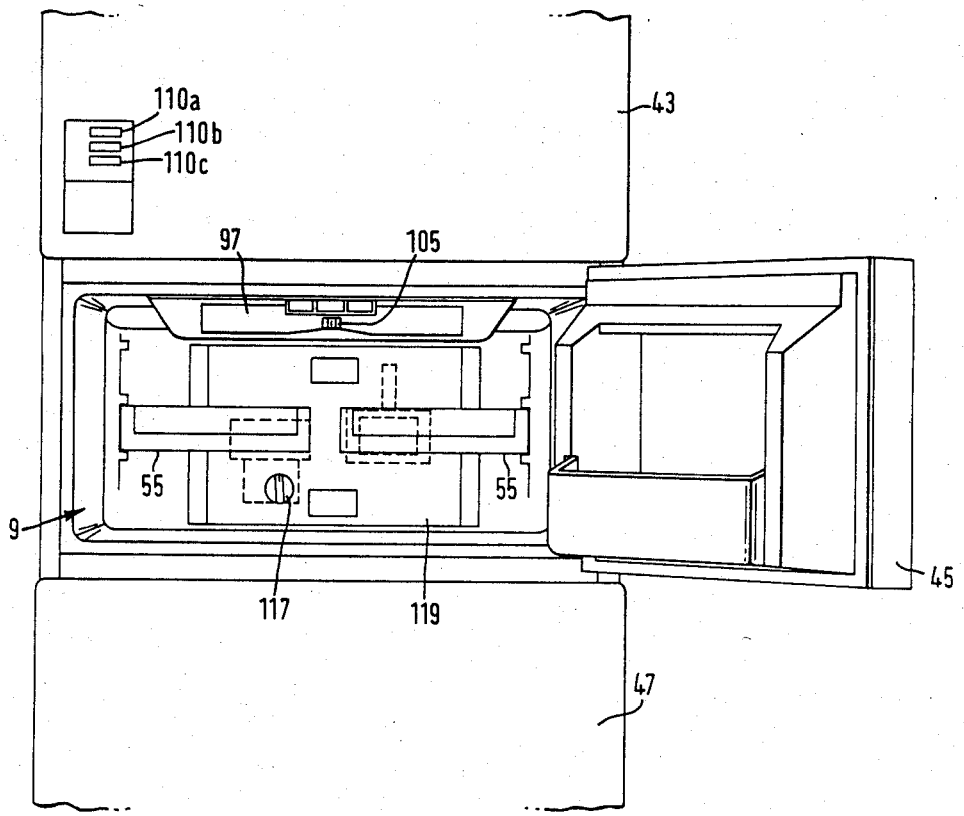
FIG. 7 is a front view of the mode-change chamber shown in FIG. 1.

As is shown in FIG. 7, the unit comprising supporting plate 85 and operating unit cover 99 is fixed to the ceiling portion of mode-change chamber 9. In this fixed state, pressing element 91*a*, provided on pressing portion 91 of operating rod 89, is in contact with the top end 79*a* of operating lever 79. Light-emitting diodes 110*a*, 110*b* and 110*c*, are mounted on the front surface of freezer door 43 so as to visually indicate the current mode of mode-change chamber 9 in response to the mode-changing operation of mode-change chamber 9.

Figure 8:
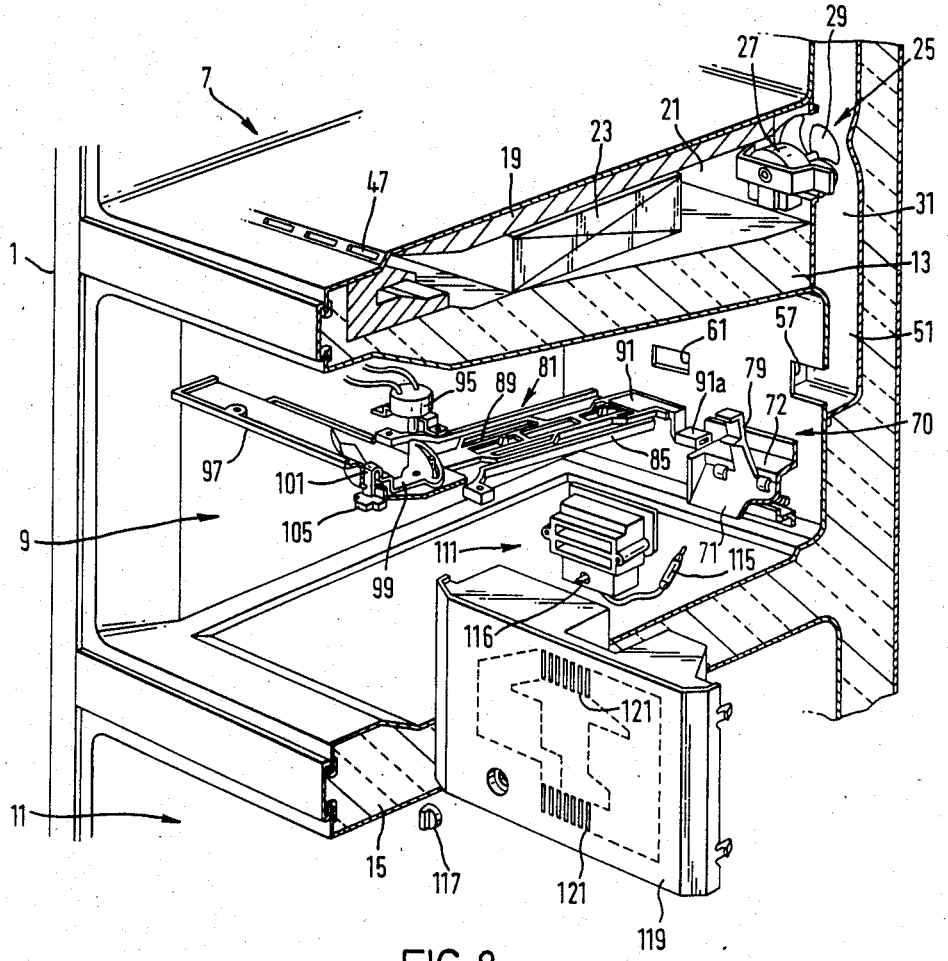
FIG. 8 is a perspective view, partly in section, of a mode-change chamber shown in FIG. 1.

As can be seen in FIG. 8, a second damper 111 is provided at third air intake port 61 of mode-change chamber 9. Second damper 111 includes a damper plate (not shown) in a case 113, and controls the amount of cold air passing through third air intake port 61 by adjusting the degree of opening of the damper plate. The damper plate is controlled as in a conventional manner—that is, its degree of opening is adjusted by expansion and contraction of a bellows (not shown) in which gas is sealed. A heat-sensitive pipe 115 is connected to the bellows in gas-tight manner, the tip of heat-sensitive pipe 115 being located within mode-change chamber 9 to sense the air temperature therein. When the temperature that is sensed by heat-sensitive pipe 115 is above the operating temperature of second damper 111, it permits cold air to flow into mode-change chamber 9 through third air intake port 61 by moving the damper plate (not shown) toward a more open position. However, when the sensed temperature is below the operating temperature of second damper 111, the flow of cold air into mode-change chamber 9 is restricted or terminated by moving the damper plate toward its closed position. Thus the operation temperature of second damper 111 is predetermined so that the temperature within mode-change chamber 9 can be maintained at e.g. 3° to 4° C., and thus the interior of mode-change chamber 9 can be used as an auxiliary refrigerator compartment. The operating temperature may be altered, within a prescribed temperature range, by the bellows which is controlled by operating a rod 116 through a temperature operating knob 117 provided on the front face of a cover 119. Cover 119 is mounted on a rear wall of mode-change chamber 9 so as to cover first damper 70 and second damper 111, and is formed with a plurality of slits 121 on its upper and lower sides for allowing the flow of cold air from these dampers 70 and 111 as shown in FIG. 8. Heat-sensitive pipe 155 can be forcibly heated by heat-sensitive pipe heater 123 (shown in FIG. 10) which is wrapped around the heat-sensitive pipe 115.

The construction of the refrigerating cycle in this embodiment will now be described with reference to FIG. 9. An auxiliary condenser 131 and main condenser 133 are connected in series to the outlet of a rotary compressor 49. Main condenser 133 is mounted on the rear wall or side wall of refrigerator main body 1, and auxiliary condenser 131 heats an evaporation tray (not shown) provided at the bottom of refrigerator main body 1. The outlet of main condenser 133 is connected to an inlet of direct-cooling cooler 33 through a drier 135, differential pressure valve 137 and capillary tube 139, all connected in series. The port 137*a* of differential pressure valve 137 is connected to the inlet of compressor 49. Therefore, differential pressure valve 137 opens when the pressure on the inlet 49*a* of compressor 49 is reduced in response to the starting of compressor 49, and closes when the pressure on the inlet of compressor 49 is increased in response to the stopping of compressor 49, so that it prevents a high-temperature refrigerant in main condenser 13 from flowing into direct-cooling cooler 33. The outlet of direct-cooling cooler 33 is connected to the input of main evaporator 23 through a capillary tube 141 and non-return valve 143 connected in series. The outlet of main evaporator 23 is connected to a suction pipe 145. Non-return valve 143 prevents heated refrigerant from reversely flowing into direct-cooling cooler 33 during a defrosting operation of main evaporator 23, while non-return valve 147 prevents compressed refrigerant from reversely flowing into main evaporator 23 from compressor 49 when compressor 49 stops.

The preferred control circuitry of this invention will be described with reference to FIG. 10. A lamp 151, provided in refrigerating chamber 11, is connected to both ends of a plug 153 through a refrigerator-door switch 155 which is closed when refrigerator-door 47 is opened. A freezer-door switch 157, which is closed when freezer-door 43 is closed, is connected to both ends of plug 153 through fan motor 27 and a first relay switch 159 connected in series. A filter circuit 161 is connected to both ends of fan motor 27. Compressor 49 is connected to plug 153 through a second relay switch 163 while filter circuit 165 is connected to both ends of compressor 49. First and second relay switches 159 and 163 are closed to drive compressor 49 and fan motor 27 when the temperature in freezing chamber 7 rises above a prescribed temperature, and are opened to stop compressor 49 and fan motor 27 when the temperature in freezing chamber 7 drops below a prescribed temperature. A first fixed contact f1 of rotary switch 95 is connected to one of the terminals of plug 153 through a first photocoupler light-emitting diode 167*a*, diode 169, resister 171 and condenser 173 all connected in series. The connecting point A between fixed contact f1 and first light-emitting diode 167*a* is connected to one of the terminals of plug 153 through a case heater 175. A second fixed contact c1 is connected to the connecting point B between diode 169 and resistor 171 through a second photocoupler light-emitting diode 167*b* and diode 177. A diode 179 is connected in parallel to second light-emitting diode 167*b*. The connecting point c between second fixed contact c1 and second light-emitting diode 167*b* is connected to the connecting point D between compressor 49 and second relay switch 163 through heat-sensitive pipe heater 123 and a diode 181. A third fixed contact r1 is connected to the connected point E between first light-emitting diode 167*a* and diode 169 through a third light-emitting diode 167*c*. One of the movable contacts m1 of rotary switch 95 is connected to another terminal of plug 153. The connecting point F between resistor 171 and capacitor 173 is connected to another terminal of plug 153 through a diode 183. The above-described rotary switch 95 is a two-circuit three-contact type. A fourth fixed contact f2 is a neutral contact position. A fifth fixed contact c2 and a sixth fixed contact r2 are connected one to another. The connecting point G between fixed contacts c2 and r2 is connected to one of the terminals of plug 153 through an inner heater 185, provided at the outer surface of mode-change chamber 9, and a third relay switch 187 connected in series. Third relay switch 187 thus close when the ambient temperature in the room in which the refrigerator of the present invention is installed, is below 10° C. The connecting point G is also connected to one of the terminals of plug 153 through damper heater 77 (see FIG. 4) and an antidew heater 189 connected in parallel. Another movable contact m2 of rotary switch 95 is connected to one of the contacts m1.

In the above-described construction of rotary switch 95, both movable contacts m1 and m2 come into contact with respective fixed contacts f1 and f2 when operating element 101 (shown in FIG. 6) is set in the "freezer" position in which it engages the engagement recess 103*a* (shown in FIG. 5) by operating knob 105. when operating element 101 is set in the "chill" position in which it engages the engagement recess 103*b*, both movable contacts m1 and m2 contact individual fixed contacts c1 and c2. When operating element 101 is set in the "refrigerator" position in which it engages the engagement recess 103*c*, both movable contacts m1 and m2 contact individual fixed contacts v1 and v2. Therefore, heat-sensitive pipe heater 123, mounted on heat-sensitive pipe 115, is energized through second relay switch 163 when operating element 101 is set in "chill" position, and case heater 175, which prevents dew formation upon the case (not shown) is energized when operating element 101 is set in the "freezer" position. Three light-emitting diode 191*a*, 191*b* and 191*c*, provided at the front surface of freezer-door 43, are selectively illuminated in response to individual photocoupler light-emitting diodes 167*a*, 167*b* or 167*c* when operating element 101 is selectively set in a desired position (i.e. "freezer", "chill" or "refrigerator") to visually indicate the current mode of the mode-change chamber 9.

Figure 10:
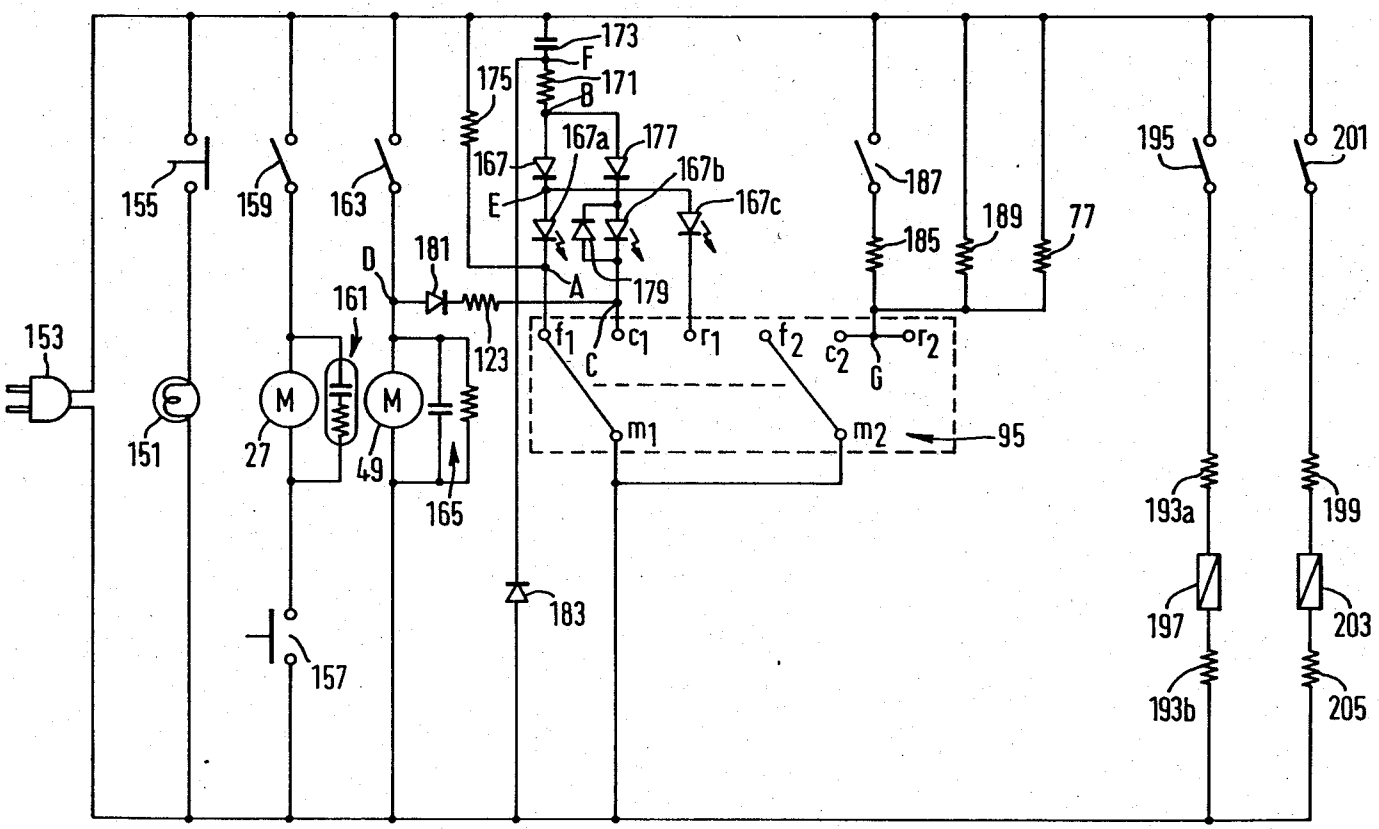
FIG. 10 is a circuit diagram used in the preferred embodiment of the present invention.

As can be seen in FIG. 10, one of the terminals of a defrost heater 193*a*, mounted on main evaporator 23, is connected to one of the terminals of plug 153 through a fourth relay switch 195, while another terminal thereof is connected to another terminal of plug 153 through a temperature fuse 197 and defrost heater 193*b* connected in series. One of the terminals of a drain-port heater 199, mounted on a drain port (not shown), is connected to one of the terminals of plug 153 through a fifth relay switch 201, while another terminal thereof is connected to another terminal of plug 153 through a temperature fuse 203 and drain-pipe heater 205 connected in series. Drain-pipe heater 205 is mounted on a drain pipe (not shown) which is provided between the drain port and evaporation tray. Heaters 199 and 205 are operated when fifth relay switch 201 is closed during defrosting operation to heat the drainpipe and drain port, enabling defrost water to flow from main evaporator 23 to the evaporation tray, in a conventional manner.

The operation of the present invention will now be described.

(1) Cooling Of The Freezing Chamber

When a rise in temperature above a prescribed point is sensed by a sensor (not shown) provided within freezing chamber 7, first relay switch 159 and second relay switch 163 are closed by the control circuit, thereby allowing operation of fan motor 27 and compressor 49. The flow of refrigerant is thus provided by compressor 49, causing direct cooling cooler 33 to directly cool the food being stored therein.

Some of the air cooled by main evaporator 23 is provided to freezing chamber 7 by fan device 25 through third duct 55 to cool the food in freezing chamber 7. When the temperature in freezing chamber 7 drops below a prescribed temperature by continuation of the cooling operation, first relay switch 159 and second relay switch 163 are opened thereby stopping compressor 66 and fan motor 27. Thus, the cooling operation is interrupted until the temperature in freezing chamber again rises above the prescribed temperature.

(2) Cooling Of The Refrigerating Chamber

When the temperature in refrigerating chamber 11 rises above a predetermined temperature, the damper plate (not shown) of damper device 60 is moved toward its open position in a conventional manner. Thus, some of the cold air is forced by fan device 25 to flow from cooling chamber 21 to refrigerating chamber 11 through second duct 53 to cool the food stored in refrigerating chamber 11. When the temperature in referigerating chamber 11 drops below the operating temperature of damper 60, the damper plate of damper 60 is moved toward its closed position to stop or reduce the flow of the cold air into refrigerating chamber 11. The interior of refrigerating chamber 11 is therefore maintained within a preferred temperature range (e.g. 3° to 4° C.) depending upon the operating temperature of damper device 60.

(3) Cooling Of Mode-Change Chamber (a) When The Chamber Is In A Freezing Compartment Mode.

Knob 105, positioned at the front of operating unit cover 97, is first moved to the position of "FREEZER" (i.e. recess 103*a* in shown FIG. 5). This movement causes cam plate 99 to rotate in the direction of the arrow A shown in FIG. 5, and thus causes engagement projection 93 of operating rod 89 to be engaged with second cam face 107*b* of cam grove 107 thereby backwardly shifting operating rod 89. Pressing portion 91 of operating rod 89 then presses operating lever 79 of the damper plate 71 of first damper 67 in response to the above-operation, so that damper plate 71 is rotated toward its open position (i.e. in the direction of arrow B shown in FIG. 4). Consequently, a greater amount of cold air flows from cooling chamber 21 through first duct 51 (which has a comparatively large flow path cross-section), thereby maintaining the interior of mode-change chamber 9 at about the same low temperature as freezer chamber 7. At the same time, rotary shaft 95*a* of rotary switch 94 is rotated in response to the rotation of cam plate 99 to close the contact (m1–f1), so that it conducts electrical current not only to case heater 175 but also to light-emitting diode 169*a* of the photocoupler.

Case heater 175 prevents the circuit case (not shown) from forming dew thereon by heating the same. Light-emitting diode 110*a*, mounted on the surface of freezer-door 43, is thus illuminated to visually indicate that mode-change chamber 9 is now in use as a freezer compartment.

(b) When The Chamber Is In A Chill Compartment Mode.

Knob 105 is shifted into the position of "CHILL" (i.e. recess 103*b* as shown in FIG. 5) to cause engagement projection 93 of operating rod 89 to be engaged with first cam face 107*a* of cam groove 107 whose radius from rotary shaft 95*a* of rotary switch 95 is smaller than that of second cam face 107*b*. Thus, the operating rod 89 is caused to be shifted to its forward position thereby closing the damper plate 71 of first damper 70 forcibly by virtue of the tension of spring 73. Consequently, cold air fed from cooling chamber 21 is not supplied from first air intake port 57, but can now be supplied into mode-change chamber 9 from third air intake port 61, where second damper device 111 is provided, through second duct 53.

Concurrently with the operation of knob 105 as described immediately above, rotary switch 95 is moved so as to close the contacts m1–c1 and m2–c2 in response to the rotation of cam plate 99, so that it causes electrical current to flow into heat-causes sensitive pipe heater 123, anti-dew heater 189 and damper heater 77. Heat-sensitive pipe 115 of second damper 111 is thus forcibly heated by heat-sensitive-pipe heater 77. Thus, even if the actual temperature in mode-change chamber 9 is lower than the temperature desired for the compartment during a refrigeration mode, heat-sensitive pipe 115 is "fooled" into sensing a higher temperature by virtue of the operation of heat-sensitive-pipe heater 77, with the result that the damper plate of second damper device 111 tends to open further than it would otherwise have opened during the refrigeration mode operation of chamber 9. In other words, the operating temperature range of second damper device 111 is essentially expanded thereby causing more cold air to be introduced into mode-change chamber 9 than would have otherwise occurred. The interior of mode-change chamber 9 is therefore maintained at a lower temperature than in the refrigeration mode thereof—i.e. at a temperature for the chill compartment mode of about −2° to 2° C., for example.

Light-emitting diode 110*b*, mounted on the surface of the freezing-door 43, is also illuminated in response to the operation of diode 167*b* of the photocoupler through the control circuit to visually indicate the current mode of the chamber 9 (i.e. as a chill compartment mode). It should be noted also that if the ambient temperature in the room containing the refrigerator of this invention drops below 10° C., third relay switch 187 closes, and current flows into inner heater, 185, thus preventing over-cooling of mode-change chamber 9.

(c) When The Chamber Is In A Refrigeration Compartment Mode.

Knob 105 is shifted into the position of "REFRIGERATOR" (i.e. recess 103*c* as shown in FIG. 5), and cam plate 99 is rotated in response to the movement of knob 105. However, operating rod 89 is not shifted because engagement projection 93 of operating rod 89 is maintained in contact with first cam face 107*a* which, due to its constant radius of curvature, maintains rod 89 in its same position as in the chill mode (i.e. forwardly spaced from lever 79 of damper plate 71). First damper device 70 is therefore maintained in its closed state. Consequently, the cold air fed from cooling chamber 21 is not supplied from first air intake port 57, but can now be supplied into mode-change chamber 9 from third air intake port 61, where second damper 111 is provided, through second duct 53 of the smallest cross-sectional dimension. The operating temperature of second damper 111 is set so as to maintain the interior of mode-change chamber 9 at about the same temperature as refrigerating chamber 11.

When the temperature in mode-change chamber 9 rises above a prescribed temperature (i.e. generally above the temperature in refrigerating chamber 11), the damper plate of second damper 111 is rotated toward its open position to permit the flow of cold air into mode-change chamber 9. Conversely, when the temperature in mode-change chamber 9 drops to a prescribed temperature, the damper plate is returned to its closed position to prevent the flow of cold air into mode-change chamber 9. As a result, the interior of mode-change chamber 9 is maintained at about the same temperature as the temperature in refrigerating chamber 11.

When cam plate 99 is rotated as describedabove, rotary switch 95 is simultaneously closed at its contacts m1–r1 and m2–r2, so that electrical current flows to anti-dew heater 189, damper heater 77 and light-emitting diode 167*c*. Light-emitting diode 110, mounted on the surface of freezer-door 43, is thus illuminated in response to the operation of diode 167*c* through the control circuit to indicate the current mode of the chamber—that is, its use as a refrigeration compartment. When the ambient temperature in the room where the refrigerator of this invention is installed drops below 10° C., third relay switch 187 closes and current thus flows into inner heater 185 provided at the outer surface of mode-change chamber 9, thereby preventing over-cooling of mode change chamber 9.

In summary, it will be seen that the present invention overcomes the disadvantages of the prior art and provides an improved refrigerator which has a mode-change chamber capable of being used in three modes-,—that is as a freezer compartment, a refrigerator compartment and a chill compartment, by a combination of opening and closing of a first damper and focible heating of a heat-sensitive pipe of a second damper. Many changes and modifications in the above-described embodiment can be carried out without departing from the scope of the present invention. Therefore, the appended claims should be construed to include all such modifications.

What is claimed is:

1. A refrigerator including a mode-change chamber capable of being operated within first and second temperature ranges and comprising:

cooling means for providing a source of cooling air;

first and second duct means for establishing communication between said mode-change chamber and said cooling means;

first and second damper means operatively coupled to said first and second duct means to selectively permit said cooled air to flow into said mode-change chamber from said cooling means; and control means for selectively operating either said first damper means or said second damper means to thereby establish said first and second temperature ranges within said mode-change chamber and including:

(a) an operating rod mounted for reciprocal rectilinear movements between an operative position wherein one end of said rod engages said first damper means to cause said first damper means to open and an inoperative position wherein said rod permits said first damper means to close;

(b) a cam follower formed on another end of said rod;

(c) a handle member which is pivotally manually movable between at least first and second positions corresponding to said operative and inoperative positions of said rod; and (d) cam means operatively coupled between said handle member and said cam follower and establishing a cam track having a first arcuate portion a second arcuate portion of a lesser radius than said first arcuate portion and a transition portion connecting said first and second arcuate portions, said cam means for translating said pivotal movements of said handle member between said first and second positions into reciprocal movements of said rod between said operative and inoperative positions, respectively, wherein said cam means causes said cam follower to follow said first arcuate portion responsive to said handle member being moved into said first portion thereby displacing said rod into said operative position thereby opening said first damper means, and wherein said cam means causes said cam follower to follow said second arcuate portion responsive to said handle member being moved into said second position thereby displacing said rod into said inoperative position whereby said first damper means can be selectively manually opened and closed.

2. A refrigerator as in claim 1 wherein said control means further includes temperature-expanding means coupled to said second damper means for expanding a control temperature of said second damper means thereby establish a third temperature range, intermediate of said first and second temperature ranges, in said mode-change chamber.

3. A refrigerator as in claim 2 wherein said temperature-expanding means includes heater means for forcibly heating said second damper means.

* * * * *